United States Patent [19]

Kawaike et al.

[11] 4,117,255

[45] Sep. 26, 1978

[54] INSULATOR BUSHING FOR HIGH VOLTAGE INPUT

[75] Inventors: Kazuo Kawaike; Tsuneo Uchiya; Ichiro Sato, all of Chiyoda, Japan

[73] Assignee: Hitachi Plant Engineering & Construction, Tokyo, Japan

[21] Appl. No.: 768,548

[22] Filed: Feb. 14, 1977

[30] Foreign Application Priority Data

Apr. 30, 1976 [JP] Japan ..... 51-54779[U]

[51] Int. Cl.[2] ..... H01B 17/26; H01B 17/52; B03C 3/34

[52] U.S. Cl. ..... 174/31 R; 55/120; 55/146; 174/211

[58] Field of Search ..... 174/11 BH, 12 BH, 14 BH, 174/15 BH, 16 BH, 17.06, 18, 31 R, 31.5, 139, 211; 55/120, 146

[56] References Cited

U.S. PATENT DOCUMENTS 3,595,983 7/1971 Muller ..... 174/31.5

*Primary Examiner*—Laramie E. Askin
*Attorney, Agent, or Firm*—Koda and Androlia

[57] ABSTRACT

An insulator bushing for high d-c voltage input to be used in an electric precipitator, etc. is designed to internally produce jet flows of sealing gas covering the insulator member. While ingress of dust-laden gas passing through the precipitator into the bushing is thereby prevented thus keeping the interior of the bushing clean, the necessary quantity of sealing gas to be supplied can be economically reduced.

3 Claims, 3 Drawing Figures

INSULATOR BUSHING FOR HIGH VOLTAGE INPUT

BACKGROUND OF THE INVENTION

This invention relates to an insulator bushing for high d-c voltage input to be used in an electric precipitator or the like.

In an electric precipitator for electrostatically collecting or separating suspended particles e.g. dirt and dust from a flow of gas or air to be cleaned, one of the essential requirements for performance of a high-efficiency dust collection lies in maintenance of a predetermined high d-c voltage being applied to the electrode. To this purpose, the ordinary insulator bushing for high d-c voltage input has been designed to provide a means to supply therein a flow of sealing gas under pressure which acts to shut off the interior of the bushing aerodynamically from the main flow channel of dust-laden gases passing beneath the insulator bushing in the precipitator. This flow of sealing gas avoids attachment or deposition of dust particles on the inner wall surface of the bushing that may cause surface leakages of current from or short discharges of the high d-c input electrode. With the ordinary insulator bushing described above, however, the problem is that due to a comparatively larger size of a sealing gas guiding member necessary for prevention of short discharges between it and the electrode, a greater quantity of such sealing gas is required for each insulator bushing; and the sealing-gas consumption will become significant particularly in case of modern large multi-stage precipitator systems employing a great number of insulator bushings. And, this problem results also in a considerable increase in cost of accessory equipments for supply of the sealing gas e.g. blowers, heaters, etc.

SUMMARY OF THE INVENTION

The present invention therefore aims to eliminate such prior art problems by providing an insulator bushing of the type specified which is capable of being kept substantially free of dirt and dust yet with a remarkably reduced quantity of the sealing gas; and the invention further attains more improved effect of sealing by prohibiting ingress of dust-laden gases into the bushing.

According to the invention, the insulator bushing provides therein an insulator member disposed substantially concentrically of the bushing, the outer surface of which insulator member is covered with jet flows of hot sealing gas produced by minor gaps formed adjacent the insulator member so that it suffers no attachment or deposition of dust from the particle-laden flow of gas passing in the precipitator.

BRIEF DESCRIPTION OF THE DRAWINGS

The invention will now be described as to its preferred embodiments by reference to the accompanying drawings, wherein.

DETAILED DESCRIPTION OF THE PREFERRED EMBODIMENTS

Figure 1:
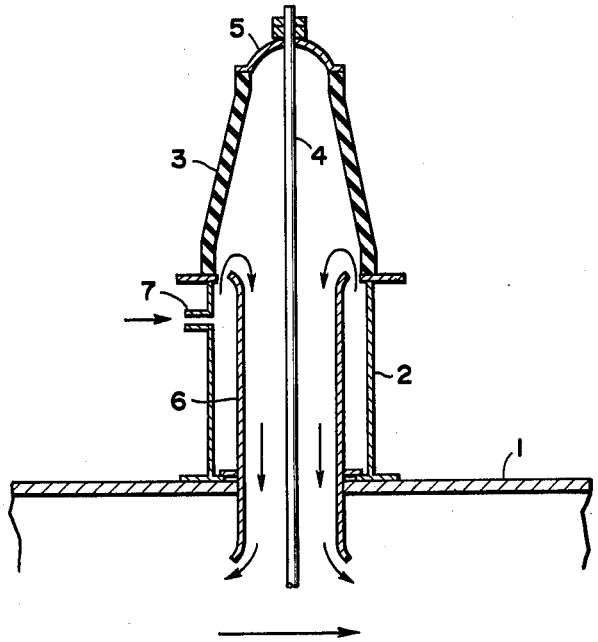
FIG. 1 PRIOR ART
FIG. 1 is a longitudinal section of an ordinary insulator bushing.

In FIG. 1 showing the ordinary type of bushing, the insulator bushing 3 is mounted via a cylindrical support 2 on and through the wall of a gas flow casing 1 of an electric precipitator (not shown). The insulator bushing contains a high d-c voltage conductor rod 4 centrally, which rod extends for connection to discharge electrodes (not shown) in the precipitator and has its upper end secured by a support fitting 5 provided at the top of the bushing 3. Surrounding the rod 4 is provided a guide spool 6 concentric to the support 2.

It is designed with this ordinary construction that by application of d-c voltage of 50 KV to 60 KV through the conductor rod 4, most of the dust particles entrained in the flow of gas passing in the casing 1 approximately at a speed of 1.5 m per second are collected electrostatically in the precipitator. If, however, some of the dust-laden gases should stray into the insulator bushing 3 and dusts are deposited around the inner wall surfaces of the bushing 3, then there will occur a lowering of the rate of withstand voltage predetermined due to surface leakages of current, or still worse, short discharges from the electrode, which consequently deteriorate the efficiency of dust collection attainable by the precipitator. To avoid this, there normally is provided a sealing gas inlet port 7 on the cylindrical support 2 through which port a continuous flow of sealing gas under pressure is conducted into the bushing 3. This sealing gas has been pre-heated by heaters, etc. in order that the inner wall surface of the insulator bushing 3 be kept dry. The jet flow of sealing gas thus sent in the bushing 3 from between the support 2 and the guide spool 6, is then conducted downwardly through the inside of the guide spool 6 so that ingress of dust-laden gases into the insulator bushing is prevented.

However, in this conventional construction, the guide spool 6 has to be of greater diameter to be spaced apart enough from the rod 4 in order to prevent occurrence of discharges between the guide spool and the high d-c voltage conductor rod 4. For example, one design case of 60 KV shows that the spool 6 diameter was necessarily selected as large as 300 mm. This causes the necessity of sealing gases in large quantities to be passed through the guide spool 6, e.g. as large as 150 $m^3/h$ or so per insulator bushing. Since one electric precipitation system usually involves the use of 4 to 64 insulator bushings, the total quantity of necessary sealing gas to be provided for will be so significantly great as to add to the expense of blowers and heater facilities.

Figure 2:
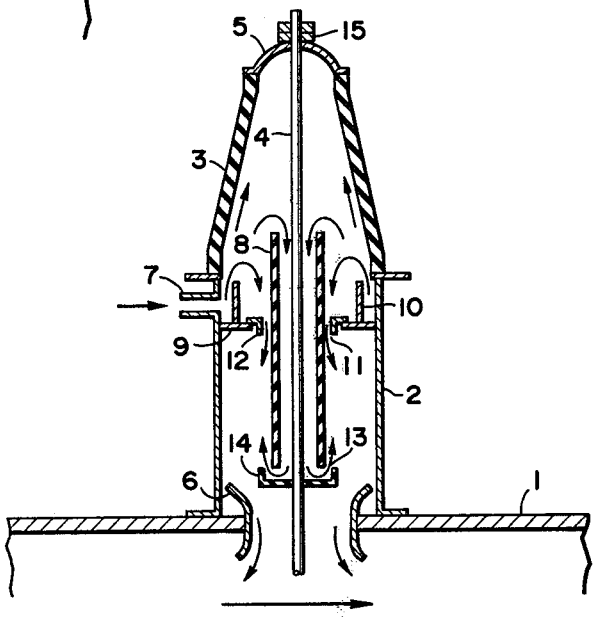
FIG. 2 is a longitudinal section of an insulator bushing according to the invention.

In FIG. 2 which shows one embodiment of the invention, the insulator bushing 3 is mounted, via a cylindrical support 2 providing a gas inlet port 7, at a predetermined position along a casing 1 of an electric precipitator (not shown). The insulator bushing 3 contains therein a high d-c voltage conductor rod 4 secured by a support fitting 5 with a fastening nut 15.

There is provided an insulator member 8 in the form of a hollow cylinder surrounding the conductor rod 4 with a predetermined spacing therebetween. This insulator member 8 is made of ceramics, fibre reinforced plastics, fluoric resins, etc., and is held in position by a not shown holder on the cylindrical support 2. In faced relation to the gas inlet port 7, is provided an upright baffle in the form of an annular plate 10 concentric to the cylindrical support 2, which upright baffle is mounted on a horizontal partition wall 9. With this arrangement, it is contemplated that the flow of sealing gas under pressure through the inlet port 7 is directed upwardly to be spread uniformly all around the inner wall surface of the insulator bushing 3. Further, there is an upper annular gap 11 of small width formed between the inner edge of the partition wall 9 and the insulator member 8. This upper gap is so shaped by an upper guide 12 secured on the wall 9 that the flow of sealing gas within the insulator bushing 3 is forced through the gap 11 into a continuous streamline along the peripheral surface of the insulator member 8.

In cooperation with the upper gap 11, there is further provided a lower gap 13 around the bottom opening of the insulator member 8, which gap 13 is defined between the insulator member 8 and a dish-like lower guide 14 of insulating material disposed to substantially close the opening of the member 8. This lower gap 13 is also shaped so as to produce a jet flow of sealing gas directed upwardly along the peripheral surface of the insulator member. A short spool 6 is disposed where the insulator bushing is opened into the precipitator's casing 1.

The invention constructed as above will be operated as follows.

When a flow of sealing gas e.g. hot air under pressure is fed into the bushing 3 through the inlet port 7, the gaseous flow is blown up from the bottom of the bushing by the baffle plate 10 to spread out around the inner surface of the bushing 3. During this flow of hot gas serving to heat up the inner surface of the insulator bushing into the dry condition, some of the gas flow is forced through the upper gap 11 into a constant-speed jet flow descending around the insulator member 8. And, in the meantime, some other portion of gas flow enters into the insulator member 8 and is forced through the lower gap 13 into a constant-speed jet flow ascending around the insulator member 8.

Accordingly, the outer surface of the insulator member 8 is entirely covered with jet flows of sealing gas. Attachment of dusts onto the member 8 thus can be prevented even in case some of the dust-laden gas passing in the casing 1 might stray into the cylinder 2.

Also, it is appreciated that those jet flows of sealing gas from the upper and lower gaps 11 and 13 are subsequently sent into the casing 1 through the guide spool 6, which prevents ingress of dust-laden gas into the cylinder 2.

According to a performance test of this embodiment, it was found that the consumption of sealing gas per insulator bushing can be reduced to 1/5 of that in the past or as small as 30 $m^3/h$, and yet no pollution is ascertained to either insulator bushing 3 or insulator member 8 after lapse of one-year operation.

It is to be noted that the same result of the invention can be attained equally by alternative arrangements that the upper gap 11 be omitted; the insulator member 8, instead of cylindrical shape, can be shaped into an inverted cone or pyramid with only the upper gap for production of jet stream of sealing gas and the lower gap being omitted.

Figure 3:
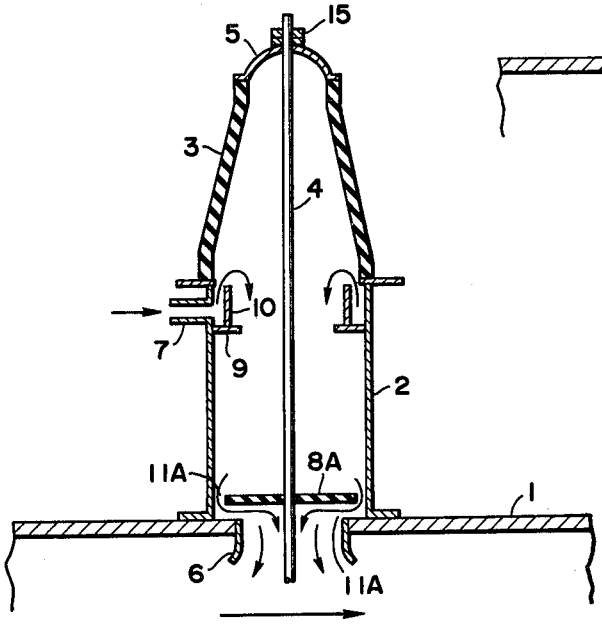
FIG. 3 is a longitudinal section of another embodiment according to the invention.

In FIG. 3, there is shown another embodiment of the invention wherein the insulator member 8 of FIG. 2 is modified into a disc-like plate 8A. With the central hole of the disc insulator 8A secured airtight on the conductor rod 4, the disc insulator 8A forms in cooperation with the lower inside of the cylinder 2 an annular small gap 11A. Other constructions are the same as those in FIG. 2. In this embodiment, similarly, it is designed that the flow of sealing gas conducted in through the inlet port 7 is forced through the gap 11A into centripetal directed jet flows along the lower surface of the disc insulator 8A, so that because of this protective flow, the insulator 8A is kept free from dusts while ingress of dust-laden gas into the bushing through the guide spool 6 is avoided.

Alternatively, similar to the embodiment of FIG. 3, the disc insulator 8A may be formed with an annular guide opening adjacent its circumferential edge secured air-tight to the cylinder 2, which annular opening is directed convergent such that a jet flow through the opening as converged be further conducted by additional deflector means along the lower surface of the disc insulator 8A.

As apparent from the foregoing, according to the invention wherein jet flows of sealing gas from small gaps are applied to cover the outer surface of the insulator member, there can be provided a number of advantages that the protective covering of the insulator member is possible with remarkably reduced quantities of sealing gas; reduction of running cost involved in the precipitation system employing the invention; improved quality of sealing assures least possible contamination of the insulator; a stabilized condition of high potential charge is maintained for a long period; assurance of high efficiency of dust collection performance, etc.

We claim:

1. Insulator bushing to be mounted upright on and through the wall of a casing and containing essentially therein a high voltage conductor, into which said bushing is conducted a continuous flow of sealing gas so as to prevent dust-laden gas passing in said casing from adversely flowing into said insulator bushing, wherein the improvement comprises:

a means for directing such sealing gas upwardly into an interior surface of said bushing;

an insulator member disposed within said insulator bushing and substantially concentric thereto, and at least one narrow gap formed adjacent said insulator member through which gap said sealing gas is jetted along a first surface of the insulator member so that said first surface of the insulator member is substantially entirely covered with said sealing gas.

2. An improved insulator bushing according to claim 1, wherein said insulator member is in the form of a hollow cylinder surrounding the high voltage conductor and a gap is provided between said hollow cylinder and said conductor such that sealing gas flows through said gap.

3. An improved insulator bushing according to claim 1, wherein said insulator member is in the form of a disc plate provided on the high voltage conductor and said narrow gap is provided about the periphery of said disc plate such that said sealing gas is jetted along a bottom surface of said disc plate.

* * * * *